United States Patent [19]

Watanabe et al.

[11] 4,050,377

[45] Sept. 27, 1977

[54] HIGH SPEED PRINTER WITH HEATED APERTURE BOARD

[75] Inventors: Akinori Watanabe; Katsuhide Tanoshima; Matsusaburo Noguchi; Kinya Hattori, all of Tokyo, Japan

[73] Assignee: Oki Electric Industry Company, Ltd., Tokyo, Japan

[21] Appl. No.: 619,259

[22] Filed: Oct. 3, 1975

[30] Foreign Application Priority Data

Oct. 30, 1974 Japan ..... 49-124271

[51] Int. Cl.[2] ..... B41F 15/00; H01J 1/02

[52] U.S. Cl. ..... 101/114; 101/DIG. 13; 346/75; 313/15; 250/324; 427/422

[58] Field of Search ..... 101/1, DIG. 13, 426, 101/114; 317/262 A, 3; 355/3, 17; 250/324–326, 423; 427/21, 422; 118/621; 313/11, 15, 37–39, 42, 337; 432/2, 36, 42, 225, 226; 346/75; 216/219

[56] References Cited

U.S. PATENT DOCUMENTS

| | | | |
|---|---|---|---|
| 3,273,496 | 9/1966 | Melmon | 101/DIG. 13 |
| 3,413,654 | 11/1968 | Strong | 101/DIG. 13 |
| 3,621,244 | 11/1971 | Miyakawa | 250/326 |
| 3,660,656 | 5/1972 | Frank et al. | 317/262 A X |
| 3,665,181 | 5/1972 | Cobb | 317/262 A X |
| 3,673,463 | 6/1972 | Gourdine | 317/3 |
| 3,779,166 | 12/1973 | Pressman et al. | 101/DIG. 13 X |
| 3,803,441 | 4/1974 | Ohsawa et al. | 313/15 X |

*Primary Examiner*—E. H. Eickholt
*Attorney, Agent, or Firm*—Peter L. Berger

[57] ABSTRACT

A high speed printer in which the ions produced between the high voltage impressed electrodes are modulated by an aperture board and then passed through an ink mist so as to electrically charge the ink particles whereby to print the desired letters, figures, signs, etc., on a printing paper, characterized in that a heating element is provided in the aperture board for lowering the relative humidity in said aperture board.

4 Claims, 6 Drawing Figures

HIGH SPEED PRINTER WITH HEATED APERTURE BOARD

BACKGROUND OF THE INVENTION

Elevated operating speed of central processor units of electronic computers has demanded corresponding speed-up of high speed printing machines, which are an output unit, and various improvements have been made to meet such demands.

A typical example of such improvements is a system in which ink is supplied to the nozzle under a very low pressure so that ink bulges out half-spherically from the nozzle end, then ink is drawn out in the form of droplets by giving an electric field between said nozzle and an accelerating electrode placed several millimeters ahead of the nozzle, and then the ink droplets are directed toward the surface of the printing paper by giving a strong electric field between the nozzle and a back bar and further electrostatically defected in both primary and secondary directions (right and left directions) to thereby print letters, signs, etc., on the surface of the printing paper.

There is also known a system in which the ions produced between the high voltage impressed electrodes are passed through an ink mist so that they carry therewith the ink particles, and then these ink particle-carrying ions are selectively adsorbed on the surface of the printing paper to thereby effect printing.

The present invention pertains to the last-mentioned system, and so this system is first described for facilitating an understanding of the present invention.

Referring to FIG. 1 which diagrammatically depicts the said system, a high voltage is applied between the anode 101 and cathode 102 to produce cations from the anode 101. These cations are attracted toward the cathode 102 and attempt to pass through an aperture board 103. This aperture board 103, as shown in FIG. 2, consists of controlling conductive layers 105, a common conductive layer 106 and an insulating layer 107 interposed therebetween, said layers being formed surrounding each of the openings 104 in the board, and the cations pass the openings 104. A predetermined amount of voltage is applied to both said controlling conductive layers 105 and common conductive layer 106 to form an electric field in each of said openings 104, so that said cations are controlled to pass or so as not to pass the openings by changing the direction of said electric field by properly selecting the potential of the controlling conductive layers 105 with relation to the common conductive layer 106. Said openings 104 are provided a plurality of lines, and the cations which have passed these openings impinge against the ink particles while passing the ink mist to electrically charge said ink particles. The ink mist is generated by vibrating the ink solution 109 in an ink mist generator 108 by supersonic vibrators 110 and discharged out from an outlet 111. The electrically charged ink particles are attracted to the cathode 102 of the back bar 112 and deposited on a printing paper 113 to print dots. In this way, letters, etc., in the form of a dot matrix are printed by controlling the feed of the printing papers 113 as auxiliary scanning. In such electrostatic high speed printers, the aperture board plays an important role. Therefore, various means are provided for protecting the aperture board against failure or damage, and may of such means are designed for preventing blocking of openings through which the ions pass. One of the most effective methods for preventing blocking of the openings is to feed air into the aperture board and then let it eject out from the openings. This method is effective for protecting the openings against dust, ink particles, etc., but it still involves a problem that if moist air is fed, the exposed metallic parts of the controlling conductive layers and common conductive layer could gather rust.

SUMMARY OF THE INVENTION

This invention is to provide a high speed printer in which a heating element is provided in the aperture board so as to lower the relative humidity in said aperture board.

OBJECTS

The first object of the present invention is to lower the relative humidity in the aperture board.

The second object of the present invention is to accomplish lowering of the relative humidity by raising the air temperature in the aperture board by providing a heating element in said aperture board.

The third object of the present invention is to eliminate any possibility of rusting on each conductive layer by keeping each said conductive layer in the aperture board away from moisture by means of the heating element provided in the aperture board.

DETAILED DESCRIPTION OF THE INVENTION

Figure 1:
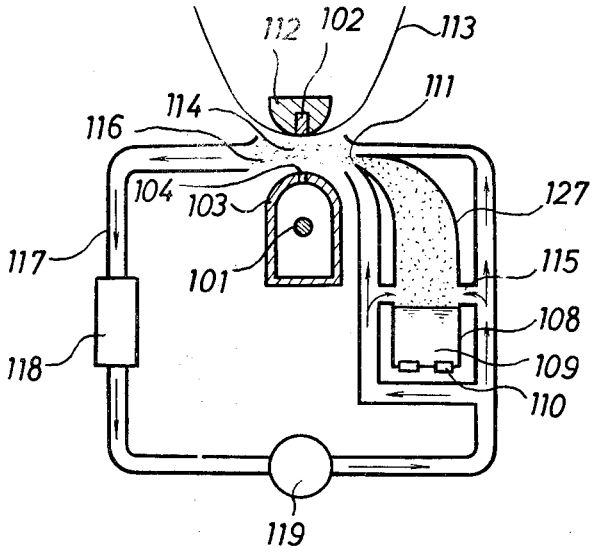
FIG. 1 is an illustrative system diagram of a high speed printer according to the present invention.
Figure 2:
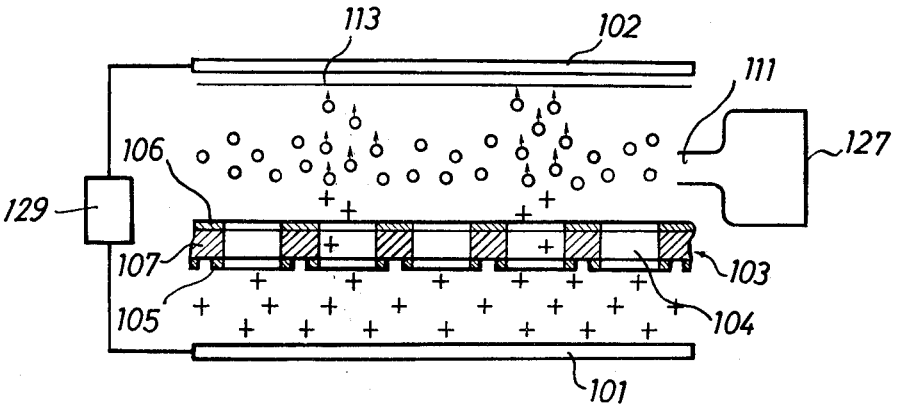
FIG. 2 is a diagramatic drawing of the printing section of the present high speed printer.
Figure 3:
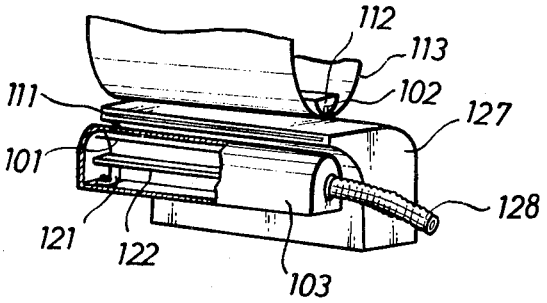
FIG. 3 is a schematic perspective view of the printing section of the present high speed printer.

An anode 101 formed from a wire-like electrode is provided in an aperture board 103 such that said anode 101 extends parallel to a cathode 102 formed in a back bar 112. Said aperture board 103 has controlling conductive layers 105 disposed on the anode side and a common conductive layer 106 on the cathode side, with an insulating layer 107 being interposed therebetween. Also, a plurality of openings 104 are formed in said board longitudinally thereof and in staggered relation to each other, and an ion controlling electrode is formed for each of said openings 104. Said controlling conductive layers 105 are connected to a driving circuit, not shown, so that they are selectively driven to a positive or negative potential with respect to the potential of the common conductive layer 106, which is maintained at a constant potential.

A means is provided for feeding ink mist to the printing section 114 located between said aperture board 103 and back bar 112. This means is designed such that an ink mist is formed by supersonic vibrators 110 provided at the bottom of a mist generator 108 which contains ink solution 109, and the ink mist is carried to the printing section 114 from a discharge port 111 by the air introduced into the system from air inlets 115 formed in the upper side face of the mist generator 108. Provided in opposition to said discharge port 111 is an ink mist and air collecting port 116 which is connected by a conduit 117 to a separator 118 and further to a main pump 119 via a cooler or like means.

Figure 4:
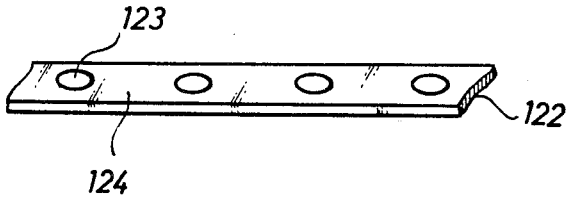
FIG. 4 is a perspective view showing an example of a heating element according to the present invention.
Figure 5:
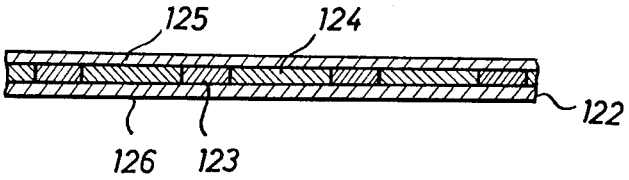
FIG. 5 is a sectional view showing another example of a heating element.
Figure 6:
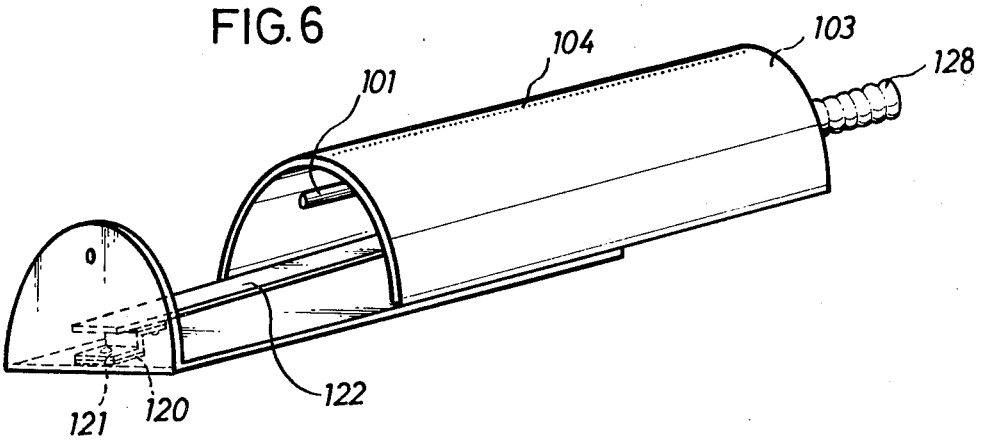
FIG. 6 is a perspective view showing a manner of mounting the heating element in the aperture board.

Also provided in the aperture board 103 are an insulator 120, disposed beneath the anode 101 and a heating element 122 fixed by support means 121 as shown in FIG. 6. Said heating element 122 is designed to generate Joule heat when an electric current is applied thereto. Preferably, such heating element is one which increases in resistivity to correspondingly decrease current flow when the temperature rises above a certain predetermined level, so as to maintain temperature constant. For instance, such heating element may be formed by implating constant-temperature resistors 123 in an insulating member 124 as shown in FIG. 4, or by placing the constant-temperature resistors 123 and insulating members 124 in layer between two electrode plates 125 and 126. In the latter case, electric current flows from one of the electrodes 125 or 126 to the other by passing the constant-temperature resistors 123, whereby said resistors 123 are heated to a fixed temperature and maintain their temperature thereafter.

Now the operation of the system having the above-described construction is described. In order to obtain a desired printing pattern, each of the selective conductive layers 105 is driven to control migration of the cations for all of the openings 104, and the cations which have passed the openings 104 enter the ink mist to carry therewith the fine ink particles. They continue their migration toward the cathode 102 until they are adsorbed on the printing paper 113 to effect printing by dots. This printing operation is carried out all together along the width of the printing paper 113, and letters composed of dot patterns are printed all together in lines with the above-said operation being designed as main scanning and feed of printing papers 113 as auxiliary scanning.

The ink mist which is to be supplied to the space between the printing paper 113 and aperture board 103 is produced by vibrators 110 provided in the mist generator 108. This ink mist is first guided into a reservoir tank 127 along with air and discharged out from the discharge port 111 with a uniform density. A part of ink mist thus discharged out is put to use for printing in dots as said above while the remainder is collected at the collecting port 116 together with the air stream, and the mixture is led into a separator 118 where the ink particles are separated from air, with the latter being further guided into a cooler for cooling and thence led into the main pump 119 whereby air is partly supplied into the reservoir tank 127 and partly used as fresh air stream.

During the above-said operation, air is incessantly supplied into the aperture board 103 through a pipe 128 while the heating element 122 generates heat of a predetermined temperature to keep the inside of the aperture board 103 at a constant temperature. Thus, air temperature in the aperture board 103 is raised to have the aperture board itself warmed. In the drawing, reference numeral 129 designates a power source.

As described above, according to the high speed printer of the present invention, as air in the aperture board is warmed to a fixed temperature by a heating element, relative humidity in the aperture board is lowered to keep off moisture from the aperture board. The aperture board itself is also warmed by warm air in the board, thus baffling deposition of moisture on each conductive layer to prevent rusting thereon. This proves helpful to keep the openings in the aperture board safe from blocking to realize stabilization of the printing quality while improving durability of the apparatus.

What is claimed is:

1. A high speed printer of the type using an ink mist formed of charged ink particles, said printer comprising electrodes having high voltage impressed thereon to produce ions, an aperture board having electric fields selectively applied therein to modulate said ions to form cations passing through said aperture board, said cations combining with said ink mist for effecting printing, and heating means located in said aperture board for heating the air received in said aperture board to effect a heating of the aperture board.

2. A high speed printer as recited in claim 1, wherein said heating means comprises a heating element located in said aperture board.

3. A high speed printer as recited in claim 1, wherein said heating means comprises an insulator located within said aperture board and constant temperature resistors implanted in said insulator to effect said heating.

4. A high speed printer as recited in claim 1, wherein said heating means comprises insulator member and spaced apart constant temperature resistors located between a pair of electrode plates.

* * * * *